US006484876B1

(12) United States Patent
Duqueroie

(10) Patent No.: US 6,484,876 B1
(45) Date of Patent: Nov. 26, 2002

(54) PACKAGING BOX CONTAINING A BUILT-IN WEDGING STRUCTURE

(75) Inventor: Florent Duqueroie, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/685,057

(22) Filed: Oct. 10, 2000

(30) Foreign Application Priority Data

Oct. 8, 1999 (FR) ..... 99 12588
Feb. 25, 2000 (FR) ..... 00 02422

(51) Int. Cl.[7] ..... B65D 85/14; B65D 5/483
(52) U.S. Cl. ..... 206/277; 206/775; 229/120.12
(58) Field of Search ..... 206/277, 525, 206/525.1, 783, 784, 775; 229/120.08, 120.12, 120.35

(56) References Cited

U.S. PATENT DOCUMENTS

| | | | | | |
|---|---|---|---|---|---|
| 2,732,996 | A | * | 1/1956 | Pantalone | 229/120.12 |
| 3,370,776 | A | * | 2/1968 | Krzyzanowski | 229/120.12 |
| 3,680,687 | A | * | 8/1972 | D'Alessio | 206/783 |
| 3,684,085 | A | * | 8/1972 | Desmond | 206/277 |
| 3,853,259 | A | * | 12/1974 | Tupper | 229/120.12 |
| 4,260,059 | A | * | 4/1981 | Roccaforte | 206/588 |
| 4,925,088 | A | * | 5/1990 | Ostrander | 229/120.12 |
| 6,112,893 | A | | 9/2000 | Aubry et al. | |

FOREIGN PATENT DOCUMENTS

| | | | | |
|---|---|---|---|---|
| DE | 94 15 714 | | 4/1995 | |
| DE | 29 902 027 | | 6/1999 | |
| EP | 0129114 | A1 * | 12/1984 | 229/125.12 |
| EP | 0 761 550 | | 3/1997 | |
| FR | 2 620 110 | | 3/1989 | |
| FR | 2 771 378 | | 5/1999 | |
| GB | 759 256 | | 10/1956 | |

OTHER PUBLICATIONS

English language Derwent Abstract of DE 29 902 027.
English language Derwent Abstract of FR 2 620 110.

* cited by examiner

*Primary Examiner*—Bryon P. Gehman
(74) *Attorney, Agent, or Firm*—Finnegan, Henderson, Farabow, Garrett & Dunner, L.L.P.

(57) ABSTRACT

A box made of cardboard or similar material is formed from a single-piece, pre-cut, substantially flat blank delimiting four faces joined together along substantially parallel longitudinal fold lines so as, after folding, to form a sleeve whose ends are closed by two end wall panels. A wedging structure is provided for wedging the object inside the box, the wedging structure being formed of a portion of the flat blank extending substantially in the continuation of a first face, to which the portion is connected by a first transverse fold line. The portion has one end adjacent to the first face, and a free end intended to be fixed to a second. The box is suitable particularly for packaging a tube.

41 Claims, 12 Drawing Sheets

FIG.4b
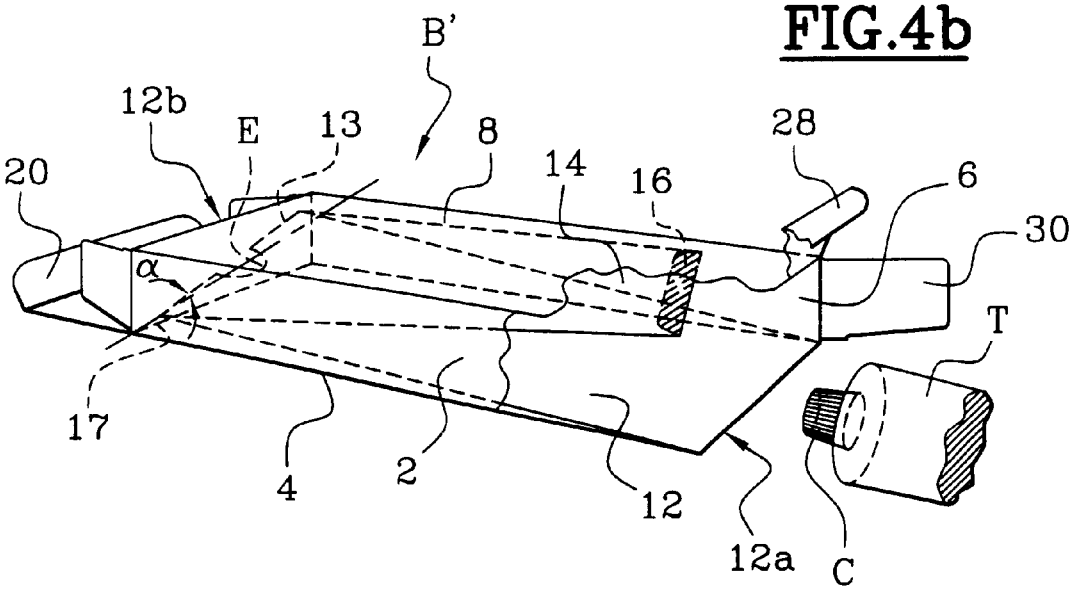
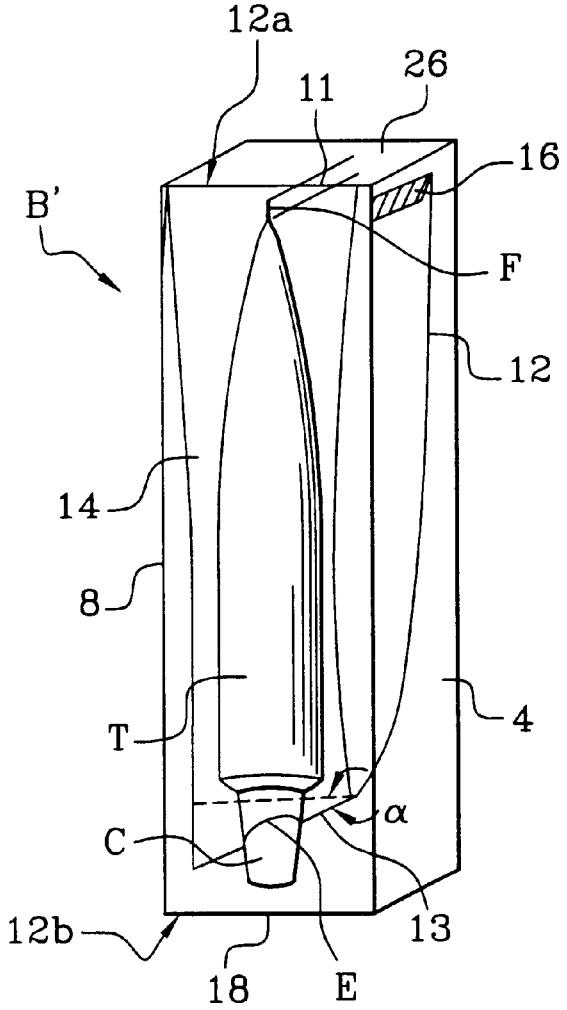
FIG.4c

PACKAGING BOX CONTAINING A BUILT-IN WEDGING STRUCTURE

The present invention relates to a packaging box, particularly one made of cardboard or a similar material, intended to house, and hold in place during transport and/or during the storage period, an object such as a flexible tube, for example one made of metal. More particularly, the invention is aimed at a packaging box of the type with built-in wedging, making it possible to improve the immobilization of the packaged object as compared with a simple box, and protect it from any damage.

Packaging boxes of this type have been known for a long time for protecting and presenting products packaged in tubes, such as cosmetic products for example facial care creams, protective sun creams, toothpastes, and also dermopharmaceutical products, adhesives, foodstuffs such as mayonnaise, etc.

These tubes, particularly when they are tubes containing a cosmetic product, often have a small volume, considerably smaller than the volume of the packaging in which they are intended to be stored. For this reason, a wedging device is desirable, to hold the tube stationary in its box, during transport and the storage period.

At the present time, many packaging boxes equipped with a wedging device are available on the market. The cost of these boxes needs to be as low as possible, hence the need for their structure to be simple and for their manufacture to be easy and lend itself it automation. To this end, every attempt is made, wherever possible, to produce packaging boxes which are equipped with a built-in wedging device, made as a single piece, by cutting out a flat blank of cardboard or some other similar material. This operation is followed by successive foldings of the various portions of the flat blank of which the box is made. The box may thereafter be strengthened in a conventional way in preparation for the packaging of an object, by gluing.

FR-A-2,771,378 discloses a box for packaging an object such as a tube, this box being obtained by successive folding operations on a one-piece flat blank comprising means for wedging the object inside the box. This flat blank consists of a succession of eleven panels, joined together by parallel fold lines. Seven panels are used to form the wedging means. The box is strengthened in three gluing zones.

The manufacture of this box requires relatively complicated industrial tooling which leads to a high cost of manufacture. Furthermore, the structure of this box requires a flat blank of relatively high surface area by comparison with the volume of the box formed after the flat blank is assembled.

Another source, DE-U-299 02 027, describes a packaging box for a tube, obtained from a pre-cut and pre-folded cardboard flat blank forming four faces intended, after folding, to form the outside of a parallelepipedal sleeve. The two open ends of the sleeve comprise, as is usual, two end wall panels capable of closing the ends of the sleeve and of forming therewith the outside of the box. The flat blank further comprises a succession of six elements of substantially triangular structure. The elements extend transverse to the longitudinal direction of the blank, thereby requiring a relatively significant amount of material. These elements are arranged inside the box so as to define a "funnel-shaped" space in which the object that is to be packaged can be wedged. This box has pretty much the same drawbacks as the box described in FR-A-2,771,378.

Hence, the present invention aims to provide a box comprising a built-in wedging system, the structure of which is simplified by comparison with the boxes mentioned hereinabove, and which can be produced automatically using an inexpensive manufacturing tool.

The invention also aims to produce a box with built-in wedging, the flat blank of which is of reduced size, as compared with the flat blanks of the aforementioned boxes.

Another aspect of the invention is a box which can be knocked down flat after the wedging structures have been assembled and fixed. By virtue of this arrangement, it is possible to store a batch of empty boxes in a minimum volume, allowing the object that is to be packaged to be introduced directly thereafter, once the box has been opened up.

It should be understood that the invention could still be practiced without performing one or more of the preferred objects and/or advantages set forth above. Still other objects will become apparent after reading the following description of the invention.

To achieve these and other advantages, and in accordance with the purpose of the invention, as embodied and broadly described herein, the invention includes a box for packaging an object. The box is preferably made of cardboard or similar material, and is intended to contain at least one object, for example a tube of cosmetic product. This box is formed from a one-piece, pre-cut, substantially flat blank delimiting four faces joined together along substantially parallel longitudinal fold lines. Thus, after folding, a sleeve is formed whose ends can be closed by two end wall panels. Structure is provided for wedging the at least one object inside the box, the wedging structure being formed of a portion of the flat blank extending substantially as a longitudinal continuation of a first face. In other words, the wedging structure is a portion of the flat blank, which portion lies on the longitudinal axis of one of the faces of the pre-cut flat blank.

These wedging structures are designed so as, when the box is assembled, to partially delimit at least one housing intended to house the at least one object, the housing being of a cross-section which varies gradually over at least part of its axial height.

Advantageously, the cross section of the housing is substantially zero at a first end of the housing and substantially equal to the cross section of the sleeve at a second end of the housing which is the opposite end to the first.

Advantageously also, the wedging structure includes at least two parts inside which the housing is formed.

Advantageously, the portion forming the wedging structure is connected to this first face by a first transverse fold line.

According to one embodiment, this portion has one end adjacent to the first face, and a free end intended, when the box is assembled, to be fixed to a second face, located facing the first one. With such a configuration, the wedging structure constitute a structure that forms a housing capable of housing the object inside the structure.

Thus, the portion of the blank forming the wedging structure includes a second transverse fold line between the end adjacent to the first face and the free end, the portion being folded about the second transverse fold line before its free end is fixed to the second face, the second transverse fold line forming the end wall of a zone of the box that is intended to house the object.

Advantageously, the free end of the flat blank portion forming the wedging structure is fixed to the second face near one end of the box located at the opposite end to the second transverse fold line.

According to a simplified embodiment, the free end of the portion may not be fixed to the second face. In this configuration, the free end is intended, when the box is assembled, to rest freely against the second face located facing the first. The resting of the second end against the second face is to a greater or lesser extent dependent on the volume of the object wedged between the two parts of the wedging structure.

Alternatively, the portion forming the wedging structure is folded about the second transverse fold line before its free end is fixed to the second face so that the wedging structure comprise at least two parts on the outside of which the housing intended to house the object is formed. In this configuration, the portion is connected to the first face by the first transverse fold line, the portion forming the wedging structure comprising an end adjacent to the first face, and a free end intended, when the box is assembled, to be fixed to a second face adjacent to the first. With such a configuration, the wedging structure constitutes a structure forming a spring capable of wedging the object between an external zone of the wedging structure and two adjacent faces of the sleeve.

Advantageously, the flat blank includes a sheet of cardboard, corrugated cardboard or any other material, such as a sheet of plastic, which has been appropriately cut and folded.

In particular, the object to be packaged is, for example, a tube, made for example of plastic, metal or a metal/plastic complex and containing for example a cosmetic product, and having one of its ends formed by an end wall obtained by squeezing together and welding along a closure line, it being possible for the tube to be of a width that increases towards the closure line. The second end of the tube has an open neck with a removable cap. However, in theory, any other object can be packaged in the box according to the invention, provided it has an appropriate shape.

Advantageously the portion forming the wedging structure comprises a second transverse fold line located between the end adjacent to the first face and the free end of the internal portion. This internal portion is folded about the second transverse fold line before its free end is fixed to the second face, the second transverse fold line forming the end wall of a zone of the box that is intended to house the object.

In other words, this then yields a box of parallelepipedal external shape, formed of two parallel main faces, two parallel side faces and two parallel end wall panels, at least one of which can remain open for introducing and extracting the object, the wedging structure comprising a two-part internal portion, these two parts making an acute angle between them. Each of the ends of the two side faces has a fold-in flap, which is folded before the two end wall panels are closed. However, it is conceivable for boxes of prismatic shape to be produced.

Advantageously, the free end of the internal portion of the flat blank forming the wedging structure is fixed to the second face near an end of the box located at the opposite end to the second transverse fold line.

Preferably the second transverse fold line is not parallel to the first transverse fold line. Specifically, the second transverse fold line may, with the first transverse fold line, make an angle $\alpha$ of between about 0° and about 45° and preferably from about 5° to about 35°. Thus, when the box is assembled, the two parts of the portion forming the wedging structure are twisted. This yields a configuration whereby the second fold line may be situated roughly along a diagonal, with respect to the cross section of the sleeve the box.

As a preference, the angle $\alpha$ is chosen so that, depending on the dimensions of the box, the box can be knocked down flat after the sleeve has been formed and after the wedging structure has been fixed to the second face.

Advantageously, the free end of the flat blank portion forming the wedging structure is in the form of a tab attached to the flat blank portion by a third fold line parallel to the first transverse fold line. This free end is fixed to a zone of the second face, which zone is located near the end of the box located at the opposite end to the second transverse fold line.

The second transverse fold line has a mid-point located a determined distance from the first and second transverse fold lines. Advantageously, the distances are substantially identical.

According to one particular embodiment, the portion forming the wedging structure has an opening, for example a central opening, stretching in particular on each side of the second fold line. This opening is intended to house and immobilize an end portion of the object consisting, for example, of the cap of a tube. If appropriate, this opening can be made on just one of the portions of the wedging structure.

According to another embodiment, the box of the invention can be used for packaging two separate objects, each object wedged at one end of the box. For this purpose, two wedging structures are provided for wedging the two objects, each of these being located at one of the ends of the sleeve. These wedging structures are formed of a first portion of the flat blank and of a second portion of the flat blank, the first and second portions being oriented away from each other, each of the portions being of a length at most equal to the height of the box, defined by the length of the longitudinal fold lines of the sleeve.

Thus, the layout of the box of the invention allows one or two objects to be inserted into the box on an automatic packaging line. This arrangement also makes it possible for the object or objects to be positioned and immobilized in a given orientation inside the box, this being convenient, particularly when the objects are fragile.

The arrangement of the box according to the invention also allows the production of a box of simple structure with a small number of parts; an appreciable reduction in the total surface area of the flat blank as compared with the volume formed by the box, due to minimal superpositions of the various panels when assembling the box; the use of a simple and inexpensive industrial tool; and a fragile object can be protected against knocks during transport. The already assembled box, ready to receive the object that is to be packaged once the box has been opened up, can be knocked down flat, making it possible to minimize the volume required for storing the box prior to use. The external faces of the box may be decorated or printed at the same time as the visible part of the wedging structure and flexible positioning of the wedging structure by elastic deformation (bending and/or twisting) is possible.

According to one aspect of the invention, a box is provided. The box includes a substantially flat blank having a plurality of faces joined together along longitudinal fold lines, the faces forming, when the blank is folded along the fold lines, a sleeve having two ends, each configured to be closed by a respective end wall, and a wedging structure configured to wedge the at least one object inside the box, the wedging structure being formed from a portion of the blank extending substantially as a longitudinal continuation of a first face, the wedging structure being designed so as, when the box is assembled, to partially delimit at least one housing configured to house the at least one object, the housing having a cross-section varying gradually along at least a portion of the housing between first and second ends of the housing.

According to another aspect of the invention, a system is provided. The system includes a box comprising a substantially flat blank having a plurality of faces joined together along longitudinal fold lines, the faces forming, when the blank is folded along the fold lines, a sleeve having two ends, each configured to be closed by a respective end wall, and a wedging structure configured to wedge the at least one object inside the box, the wedging structure being formed from a portion of the blank extending substantially as a longitudinal continuation of a first face, the wedging structure being designed so as, when the box is assembled, to partially delimit at least one housing configured to house the at least one object, the housing having a cross-section varying gradually along at least a portion of the housing between first and second ends of the housing, and a tube containing a product.

According to a further aspect of the invention, a box for containing at least two separate objects is provided. The box includes a single-piece, pre-cut, substantially flat blank having four faces joined together along substantially parallel longitudinal fold lines, the faces forming, when the blank is folded along the fold lines, a sleeve having two ends, each configured to be closed by a respective end wall, and two wedging structures, each configured to wedge one separate object inside the box, the wedging structures being formed from portions of the flat blank, one portion extending substantially as a continuation of a first face and a second portion extending substantially as a continuation of a second face, the wedging structures being designed so as, when the box is assembled, to partially delimit two housings, each housing configured to house one respective object, each housing having a cross-section varying along at least a part of its length.

According to yet another aspect of the invention, a method of making a box for containing at least one object is provided. The method includes providing a substantially flat blank having a plurality of faces joined together along longitudinal fold lines, folding a portion of the blank forming a wedging structure and extending substantially as a longitudinal continuation of a first face along a first transverse fold line, folding the portion of the blank forming the wedging structure along a second transverse folding line such that a free end of the portion is adjacent to a second face when the box is assembled, and folding the blank along the longitudinal fold lines to form a sleeve having two ends.

In order to give a better understanding of the present invention, a number of embodiments of a packaging box according to the invention and depicted in the appended drawings will now be described by way of purely illustrative and non-limiting examples. Beside the structural arrangements set forth above, the invention could include a number of other arrangements such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1*a* depicts a view of a flat blank, before folding, of a box according to a first embodiment of the invention;

FIG. 1*b* depicts a view of a flat blank, before folding, of a box according to a second embodiment of the invention;

Figure 1A:
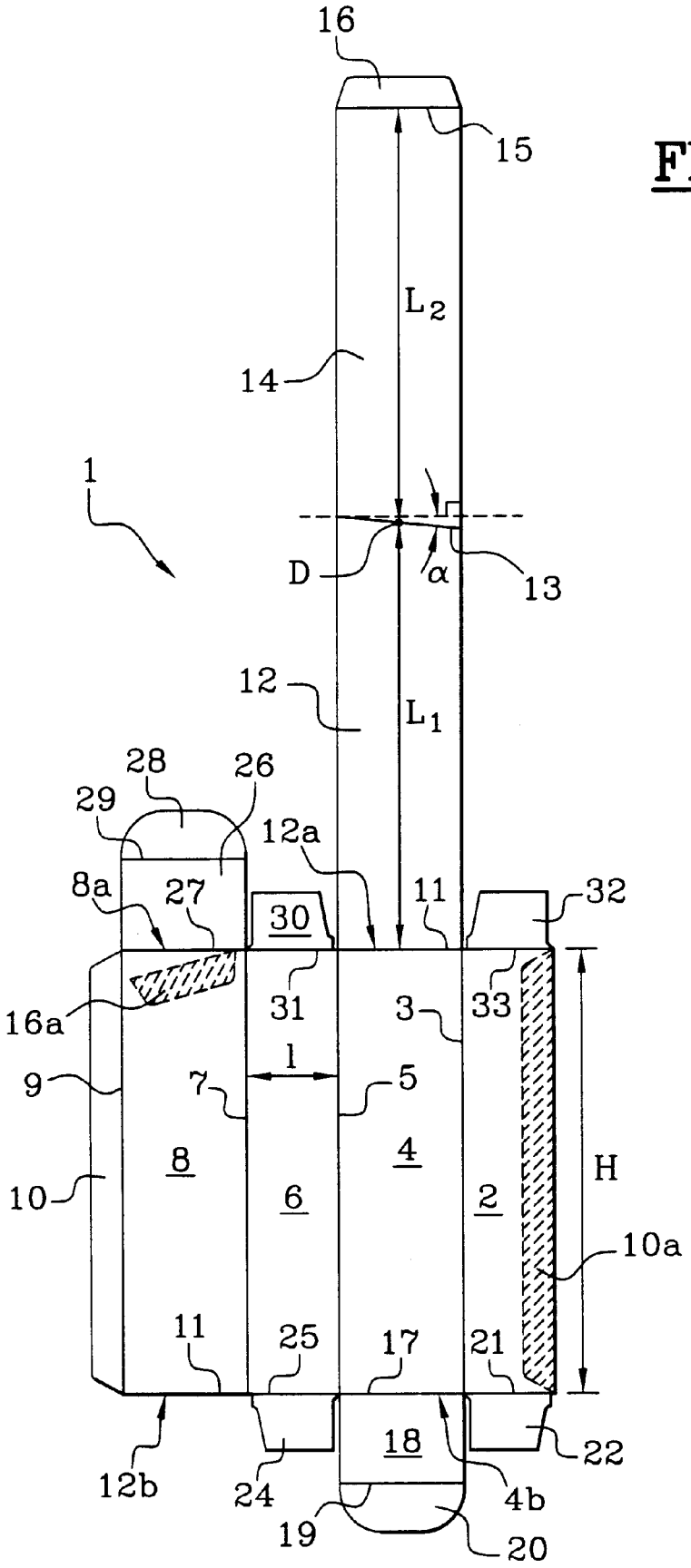
Figure 4A:
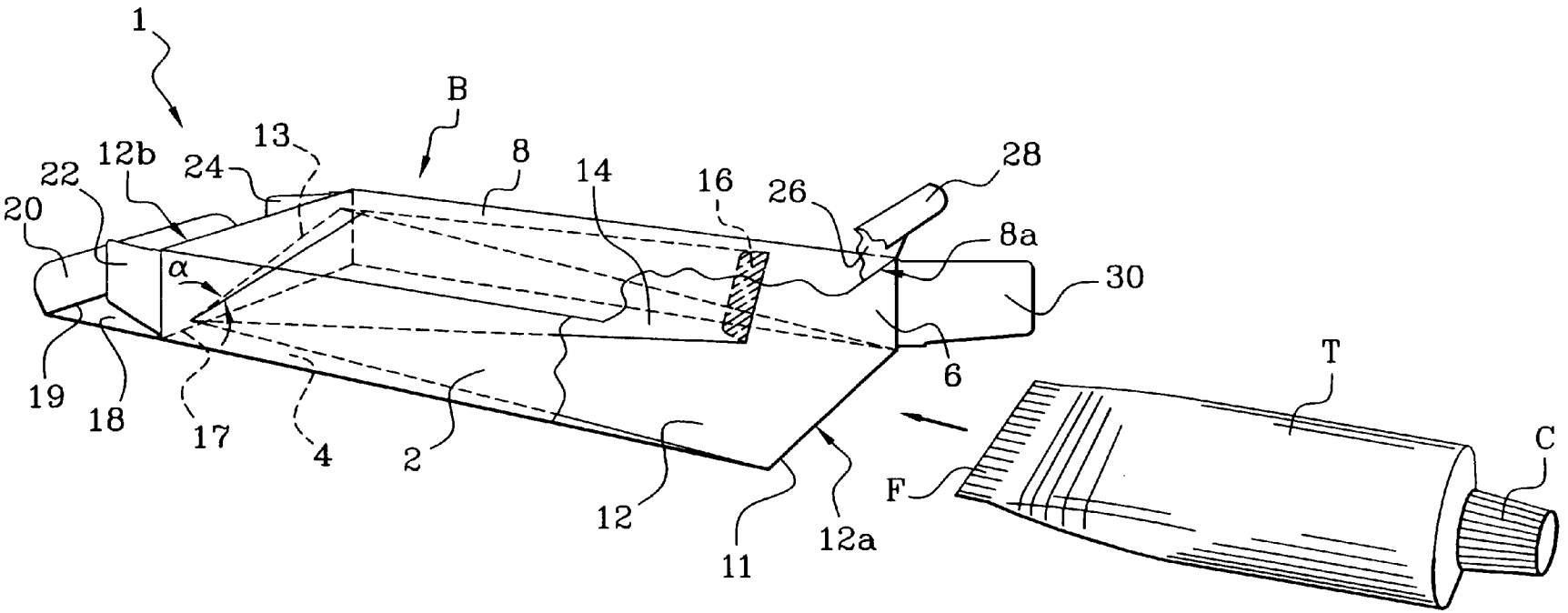
Figure 5:
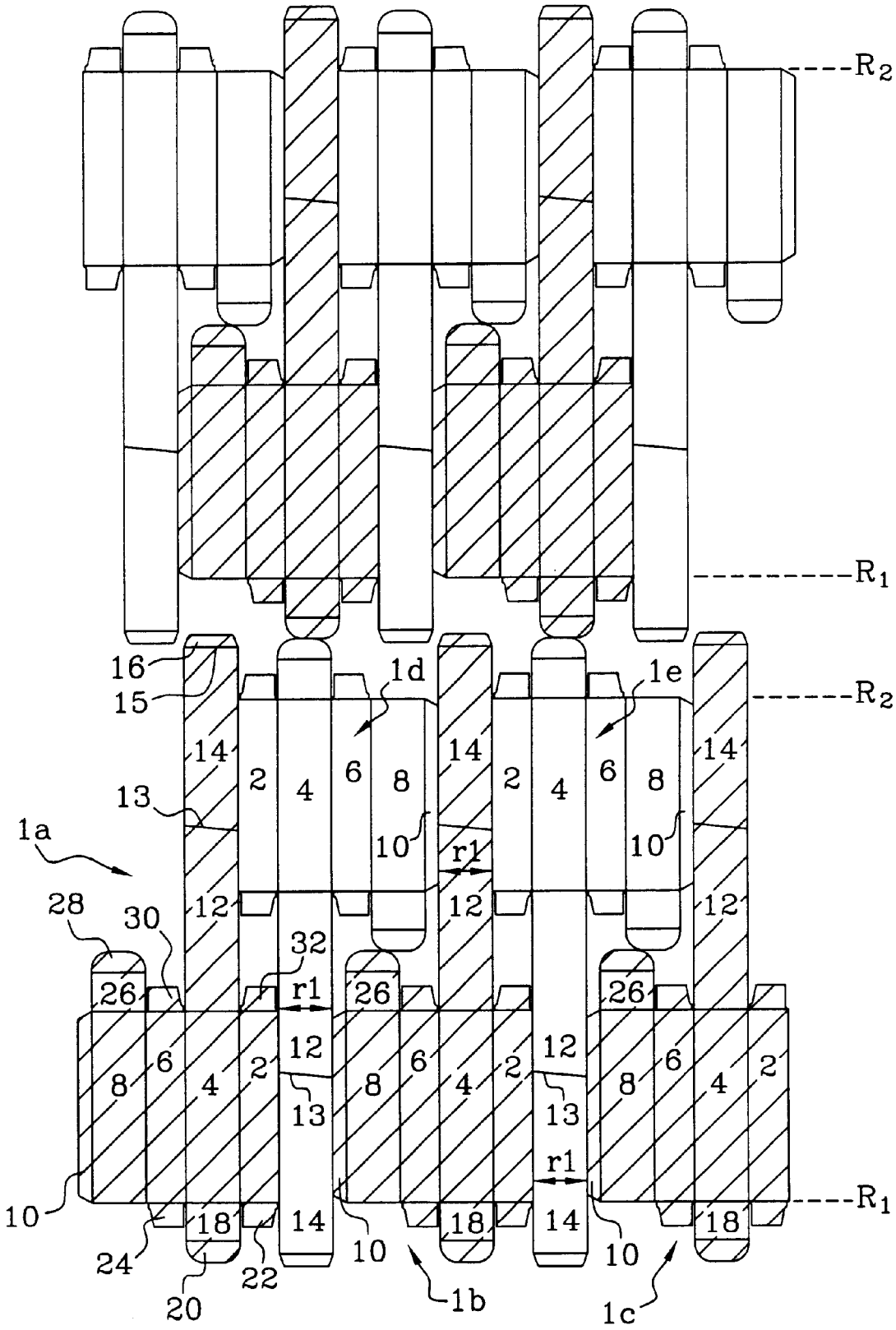

FIG. 4*a* depicts a diagrammatic perspective view of the box depicts in FIGS. 1*a,* 2 and 3, with the external walls partially cut away, this box being obtained after folding the flat blank;

FIG. 4*b* depicts a diagrammatic perspective view of a box according to an alternative form of the box of FIG. 4*a,* with the external walls partially cut away;

FIG. 4*c* depicts a diagrammatic view in longitudinal section of the box of FIG. 4*b,* after a tube has been introduced;

FIG. 5 depicts a diagrammatic view of an arrangement of a multitude of flat blanks as per the flat blank of FIG. 1*a;*

Figure 6A:
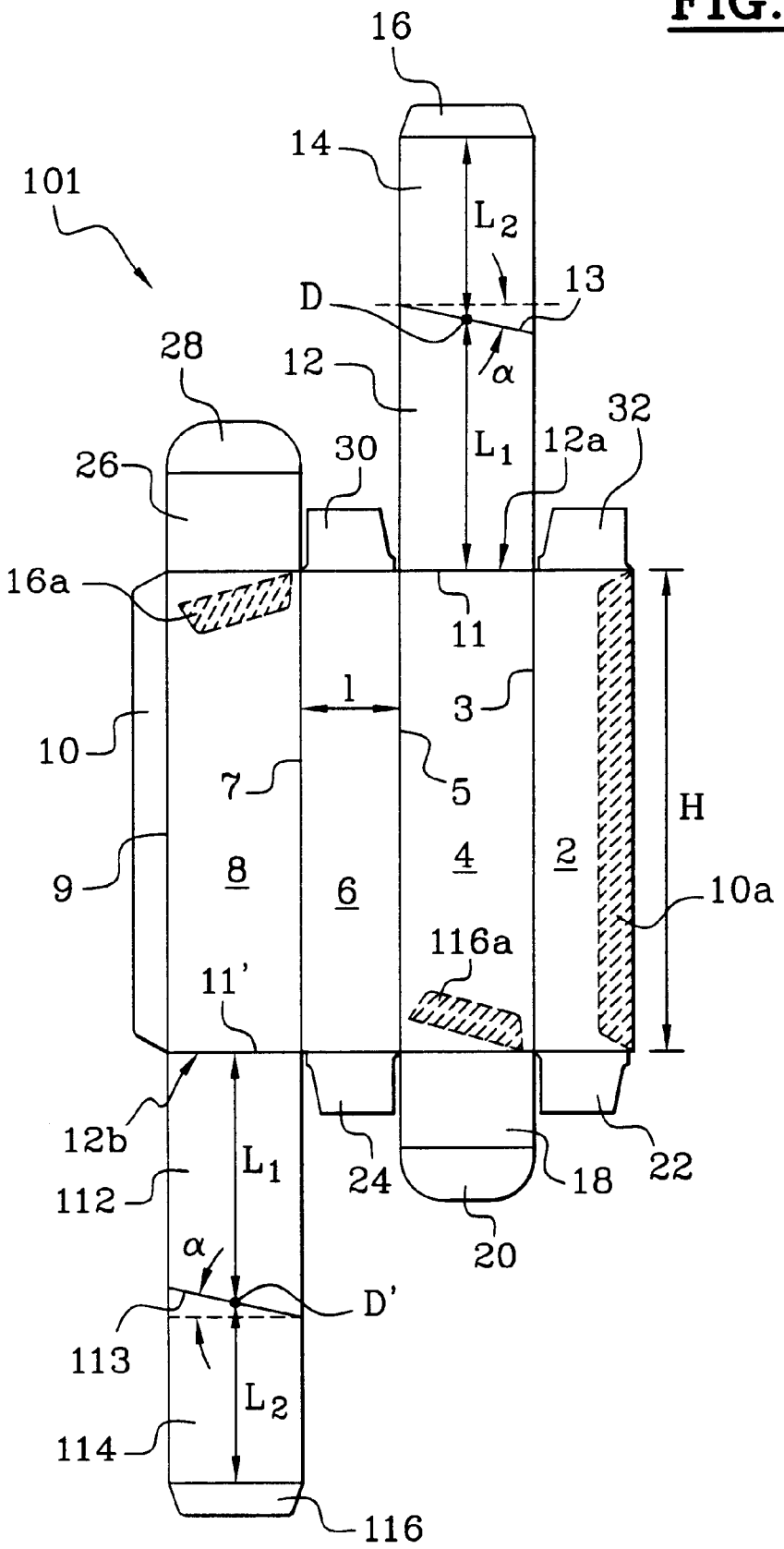
Figure 6B:
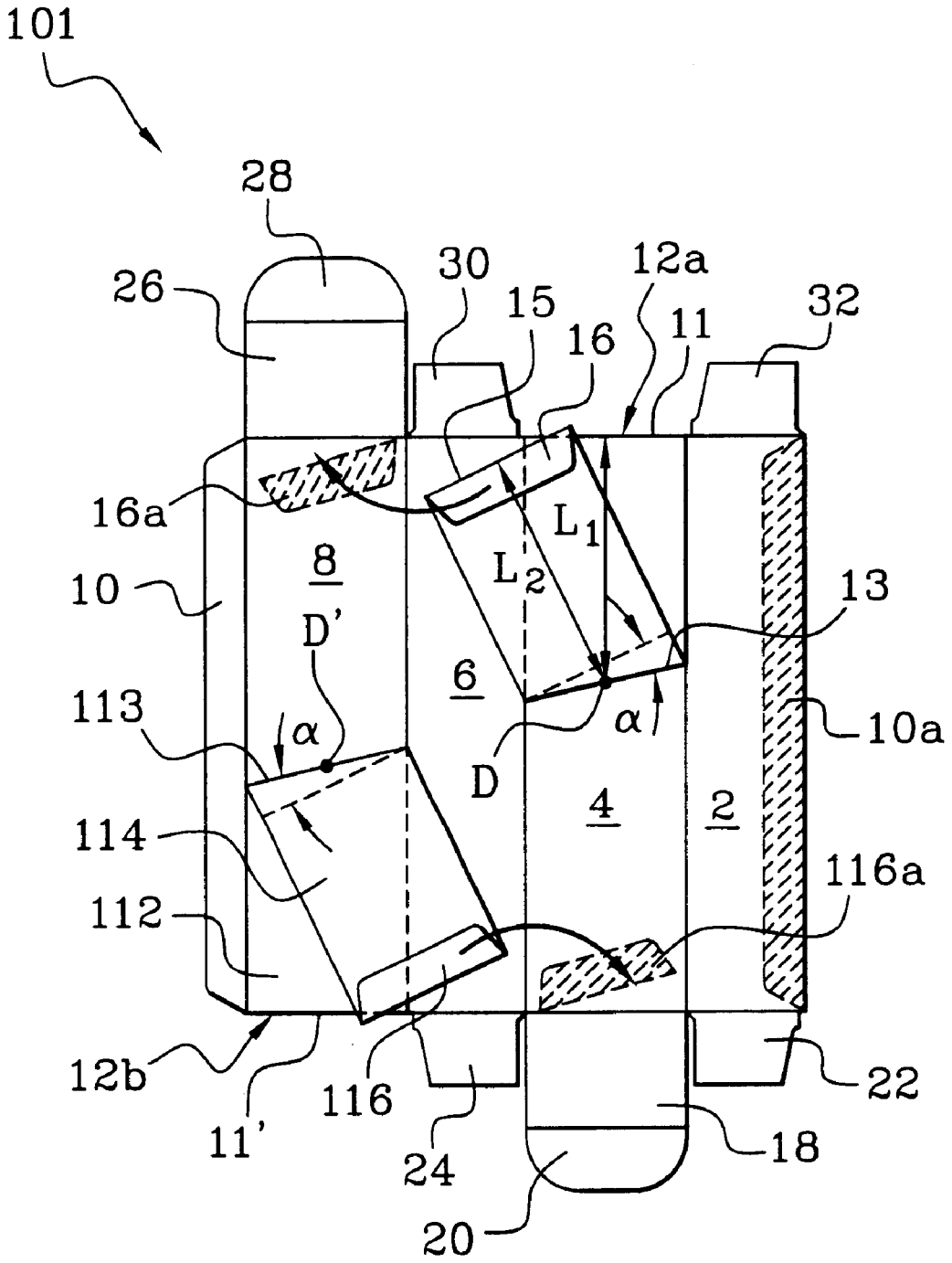
Figure 7:
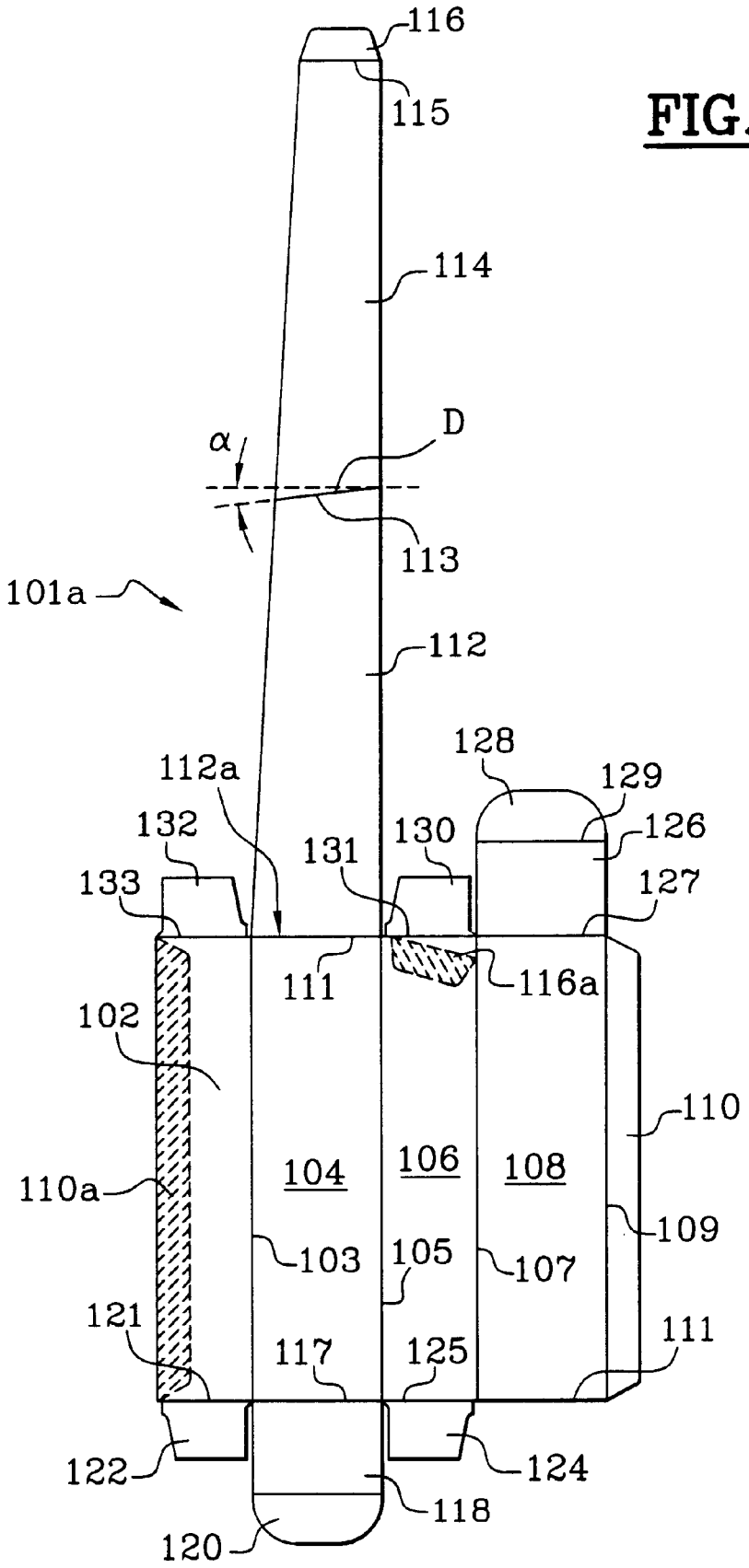
Figure 8:
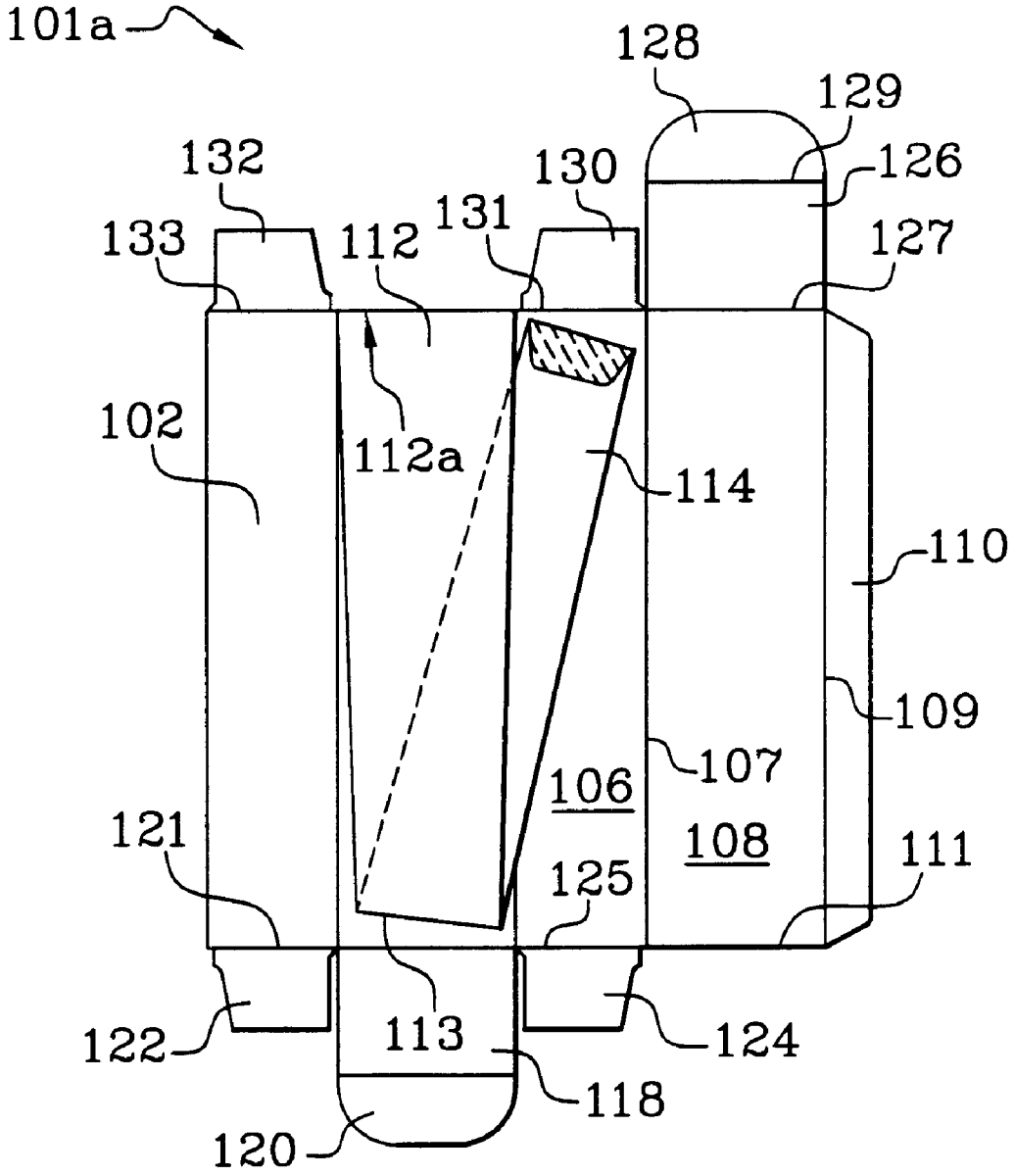
Figure 9:
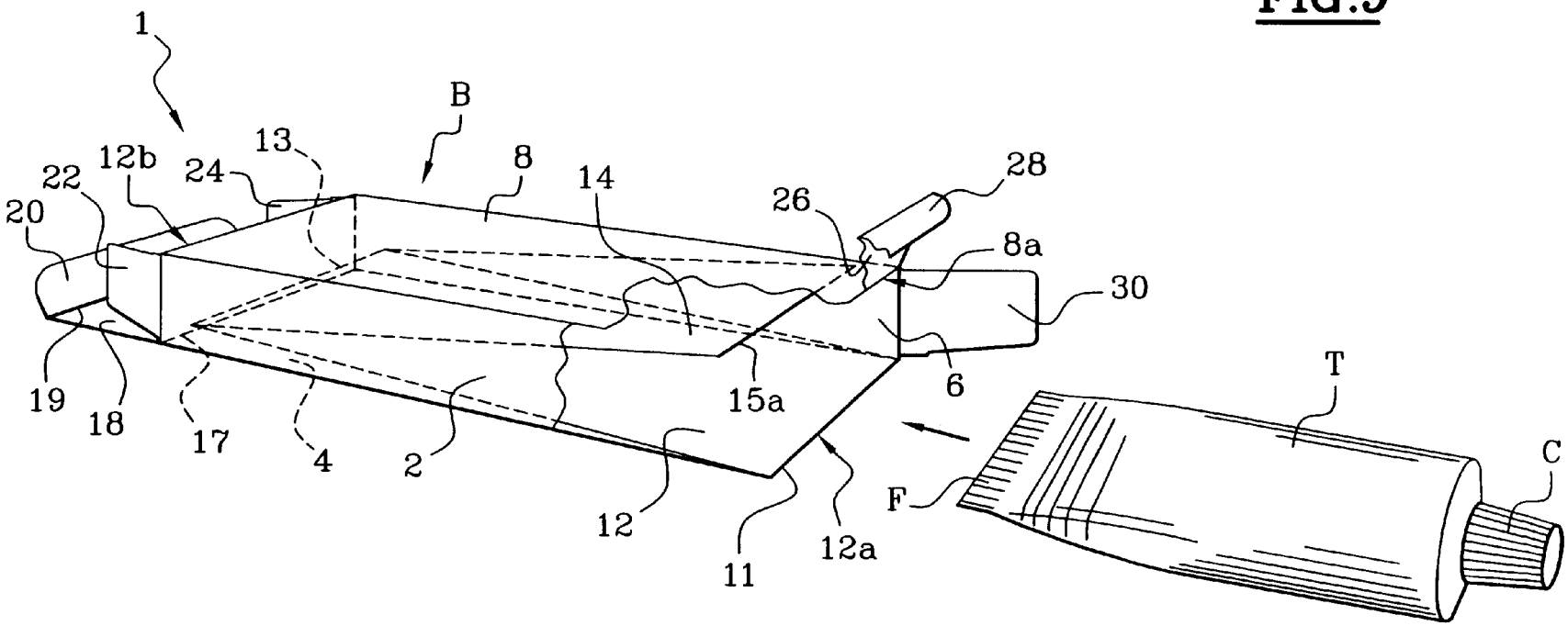

FIG. 6*a* depicts a view of a box flat blank, before folding, according to another embodiment of the invention;

FIG. 6*b* depicts a view of the flat blank of FIG. 6*a,* during the folding of the wedging structure;

FIG. 7 depicts a view of a flat blank, before folding, of a box according to another embodiment of the invention;

FIG. 8 depicts a view of the flat blank of FIG. 7, during the folding of the wedging structure; and FIG. 9 depicts a diagrammatic perspective view of an embodiment which has been simplified by comparison with the embodiment depicted in FIG. 4*a,* with partial cut-away of the external walls.

Reference will now be made to the present preferred embodiments of the invention, examples of which are illustrated in the accompanying drawings. Wherever possible, the same reference numerals are used in the drawings and the description to refer to the same or like parts.

FIGS. 1*a,* 2, 3 and 4 show the successive stages in forming a box B from a flat blank 1, of parallelepipedal shape, comprising three pairs of external rectangular faces. Each pair of faces is formed of two faces facing each other: two main faces 4, 8, two side faces 2, 6, and two closure end wall panels 18, 26, by means of which the box can be opened or closed. The faces 2, 4, 6, 8, and a gluing tab 10, are joined together by parallel fold lines 3, 5, 7 and 9 which determine the height H of the box.

Having folded the faces 2, 4, 6, 8 then glued the tab 10 onto a zone located on a free edge 10*a* of the face 2, a sleeve of parallelepipedal overall shape is obtained. This sleeve has two open ends 12*a* and 12*b* Each of the side faces 2 and 6 has two flaps 22, 32 and 24, 30, connected to the respective ends 12*a* and 12*b* of the side faces 2, 6, by fold lines 21, 33 and 24, 31, respectively. The main face 4 has a first transverse fold line 11 formed at the end 12*a,* and attached to an elongate portion 12, 14, 16 which extends longitudinally (i.e., in the same direction as fold lines 3, 5, 7, and 9) from the main face 4. A free end of the elongate portion has a tab 16, connected and folded about a fold line 15. This end 16 is intended to be fixed to a second face 8 of the box which, when the box is in the made-up position, lies facing the first face 4. The flaps 12 and 14 constitute a device for internally wedging the object that is to be packaged in the box.

These flaps 12, 14 are connected by a transverse fold line 13, so as to make an angle $\alpha$ with the first transverse fold line 11. The angle $\alpha$ can vary according to the dimensions of the box, particularly according to the width of the side faces of the sleeve and to the mean length of the wedging structure $L_1$, corresponding to half the total length of the flaps 12, 14. Thus, a mid-point D is defined, this being located at the middle of the fold line 13. The point D defines the distances $L_1$ and $L_2$, of substantially equal length, connecting the point D to the fold lines 11 and 15, respectively, located on each side of the fold line 13.

The angle α can range from 0° to 45° and preferably ranges from 5° to 35°. When the angle α is 0° or close to 0°, the sleeve formed cannot be knocked down flat. For this reason, the angle a is preferably chosen so that the sleeve formed with the wedging structure can be knocked down flat.

The end 4*b* of the face 4, which is opposite to end 12*a,* has a fold line 17 connecting the end wall panel 18 to the face 4. A tab 20, connected to the end wall panel 18 by a fold line 19 parallel to the fold line 17, is intended to allow the end of the sleeve to be closed once the flaps 22 and 24 have been folded in.

Figure 2:
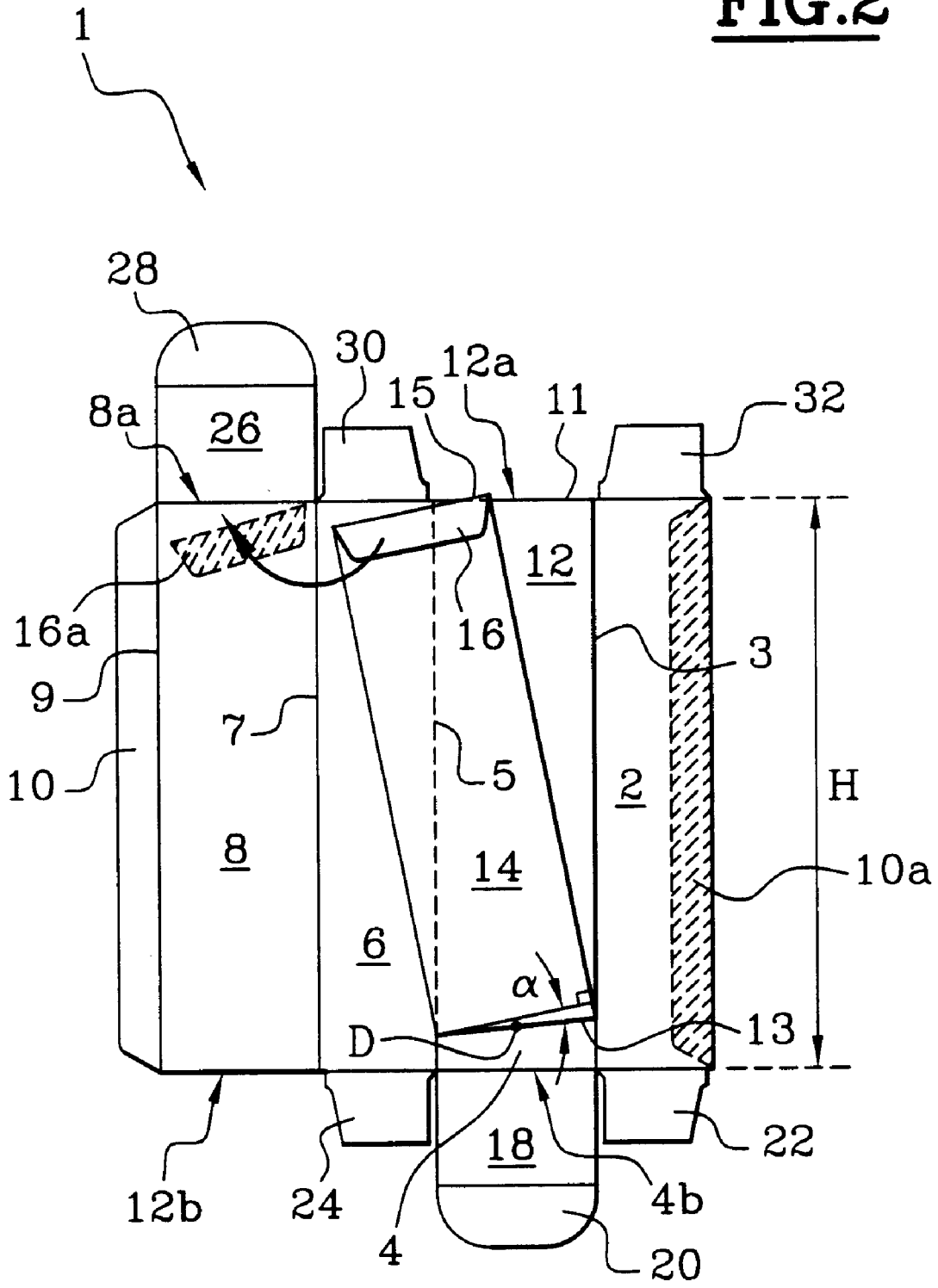
FIG. 2 depicts a view of the flat blank of FIG. 1*a,* during the folding of the wedging structure.

It can be seen, particularly from FIG. 2, that the flap 12 is folded down onto the face 4, then the flap 14 is folded along the fold line 13, towards the side face 6, thus defining the angle α.

Figure 3:
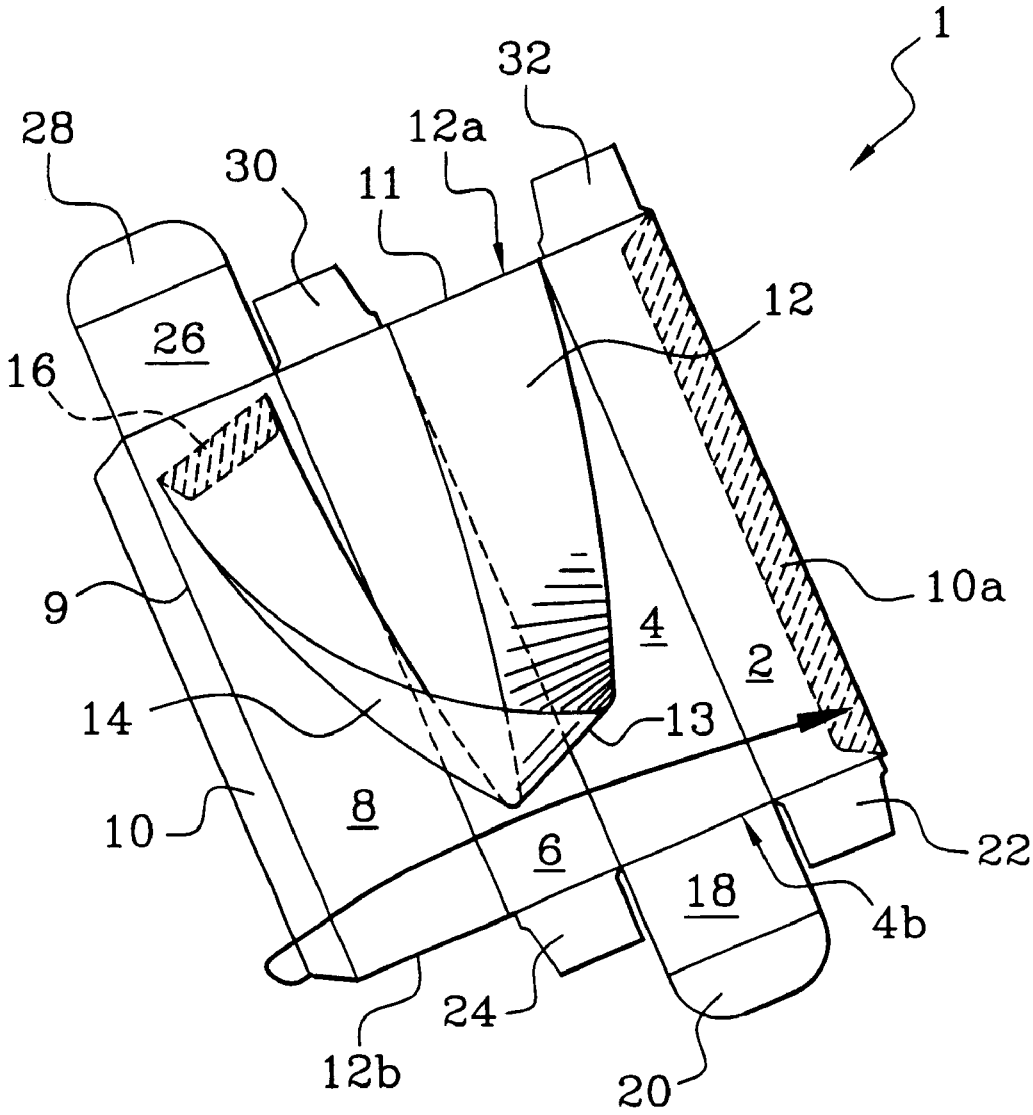
FIG. 3 depicts a view of the flat blank of FIGS. 1*a* and 2, during the fixing of the wedging structure.

Once the end tab 16 has been folded down onto the portion 14, the visible face of the tab 16 is coated with glue and fixed to a zone 16*a* located near the end 8*a* of the face 8. This then yields a configuration as illustrated in FIG. 3.

The tab 10 is then folded along the longitudinal fold line 9 and, in its turn, coated with glue. Once the faces 2, 4, 6 and 8 have been folded, the tab 10 is glued to the end edge 10*a* of the face 2. When the angle α is suitably chosen, the flat blank of FIG. 3, after the tab 10 has been glued to the edge 10*a,* has a structure which can be substantially knocked down flat.

The opened-up sleeve, as shown in FIG. 4*a,* is ready to receive the object T that is to be packaged. In the example under consideration, this object is a tube which has an end wall F and, at the opposite end, a removable cap C. According to the embodiment of FIG. 4*a,* the tube is introduced into the sleeve bottom (end wall F) first.

To close the closed end of the sleeve at the end 12*b,* the flaps 22 and 24 are folded in, and then the end wall panel 18 is folded, along the fold line 17. Next, the tab 20 is folded along the fold line 19 and tucked into the sleeve, at the end 12*b.*

Similarly, the other end 12*a* is closed by folding in the flaps 30 and 32, and then the end wall panel 26 is folded along the fold line 27. The tab 28 is folded along the fold line 29 and tucked into the sleeve at the end 12*a.*

The tube T thus finds itself immobilized for transport and storage.

In the description of the figures which will follow, the references of the parts which are identical to the parts described with reference to FIGS. 1*a,* 2, 3 and 4 are kept. Only those parts which differ from the embodiment described bear references which have been modified by "'" or "b" or which bear reference numerals increased by 100.

Figure 1B:
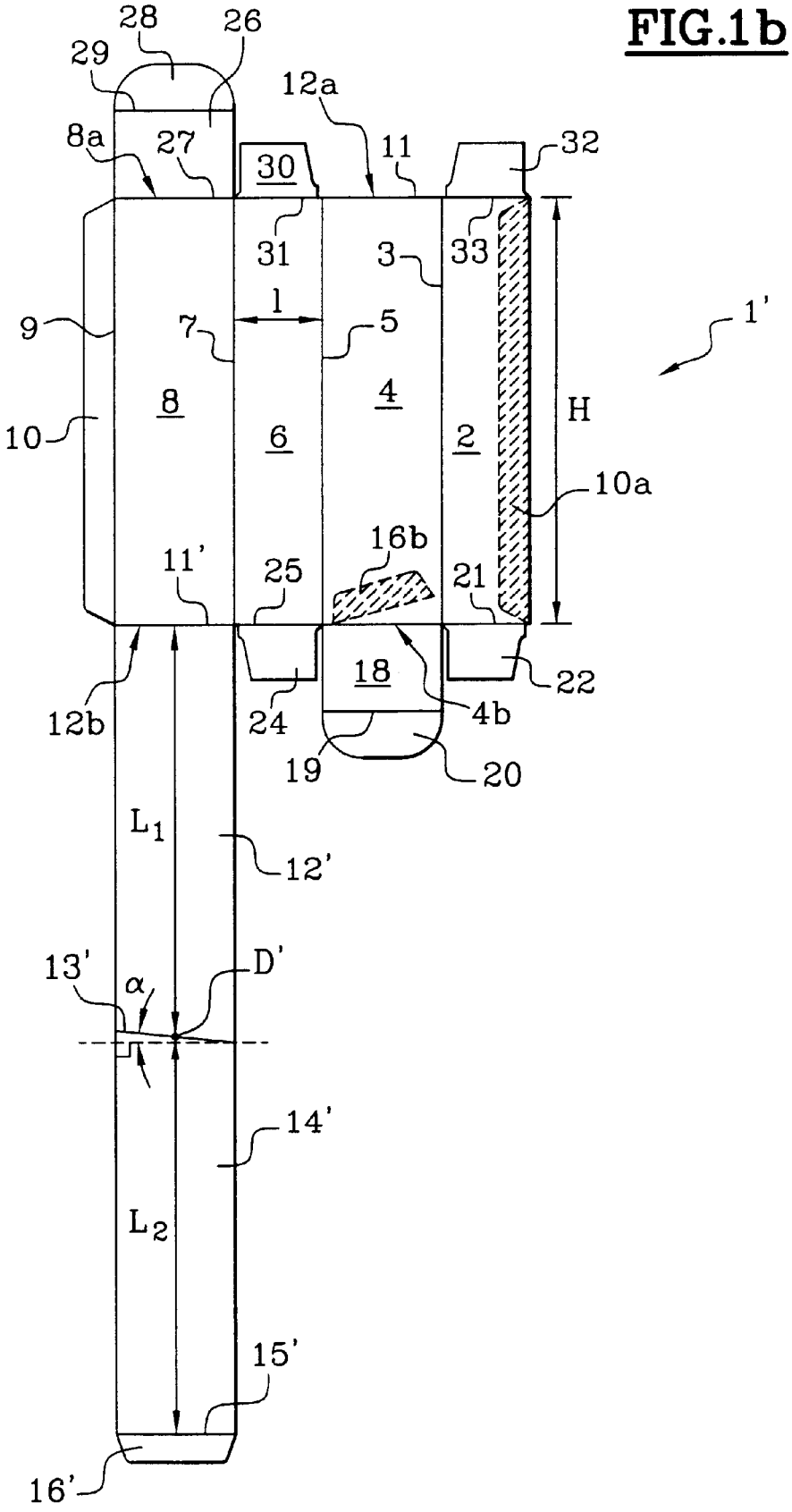

FIG. 1*b* depicts another embodiment of a flat blank 1'. This embodiment differs from the embodiment in FIG. 1*a* in that wedging structure 12', 14' is attached to the second face 8, opposite the first 4, and arranged on the second end 12*b* of the sleeve, opposite the first 12*a,* along a fold line 11'. In consequence, an end tab 16', connected to the wedging structure 12', 14' along a fold line 15', is intended to be fixed to a zone 16*b* located near the end 4*b* of the face 4. The rest of the flat blank 1' is identical to the flat blank 1 of FIG. 1*a.* Thus the box can be assembled and filled in a way similar to the way described with reference to FIGS. 1*a,* 2, 3 and 4*a,* and requiring no further detailed description.

FIGS. 4*b* and 4*c* illustrate another embodiment of a box B', which differs from the box B of FIG. 4*a* only in that the wedging structure 12, 14 has an opening E, particularly a central opening, extending on each side of the fold line 13. The shape of this opening is chosen so that one end C of the object T that is to be packaged can be housed and immobilized therein. In this particular instance, it is the cap C of the tube which partially passes through the opening E (FIG. 4*c*), thus immobilizing the tube.

FIG. 5 illustrates an advantageous arrangement of a great many flat blanks on a sheet of cardboard, before cutting.

It can be seen that a first row of flat blanks (1*a,* 1*b,* 1*c*), all facing the same way, is arranged in a line ($R_1$), each flat blank being separated from a neighbouring flat blank by a distance ($r_1$) corresponding to the width of the internal wedging structure (12,14). A second row of flat blanks (1*d,* 1*e*) face in the opposite direction to the flat blanks of the first row, and are arranged in a second line ($R_2$) parallel to the first, so as to form a top-to-tail arrangement of the flat blanks. The wedging structure (12, 14) of a first row occupies the area formed by the offset ($r_1$) of a second row, and vice versa.

By comparison with the flat blanks of boxes of the aforementioned prior art, this arrangement makes it possible to minimize the amount of cutoffs that remain after the flat blanks have been cut out. In other words, by comparison with conventional flat blanks, the number of flat blanks cut out per sheet is improved.

FIGS. 6*a* and 6*b* depict a flat blank 101 according to yet another embodiment of the invention. The flat blank 101 is intended to form a box used for simultaneously packaging two objects and comprising two independent internal wedging structures 12, 14; 112, 114. A first wedging structure 12, 14 is attached to one end 12*a* of the face 4 of the flat blank. A second wedging structure 112', 114' is attached to the end 12*b,* which is the opposite end to the end 12*a,* of the face 8. The length of the wedging structures is chosen so that their respective lengths do not exceed the height H of the box. It is thus possible to place two objects in the box, superposed over each other with the narrow or "wedged" end of each wedging structure being at an opposite end of the box.

In particular, the combined length of the portions 12 and 14 may differ from the combined length of the portions 112' and 114', thus allowing them to be tailored to suit the wedging of two objects of different sizes.

The wedging structures are bent, the sleeve is formed, the objects are inserted into the sleeve and the boxes closed in a similar way to the operations described previously with reference to FIGS. 1*a* and 1*b.*

FIGS. 7 and 8 illustrate another embodiment, whereby a flat blank is denoted overall by the reference 1*a.* The various parts which are identical or similar to the parts of the flat blank according to FIGS. 1*a,* 2, 3 and 4 bear the reference numerals of those figures, increased by 100. Only a partial detailed description of these parts will be given again.

FIGS. 7 and 8 show the four faces 102, 104, 106 and 108 intended, after folding, to form a parallelepipedal sleeve which, with the top and bottom end wall panels 126 and 118, form the outside of the box.

The wedging structure includes two portions 112 and 114. The portion 112 is attached to a first main face 104. There is a transverse fold line 111 between the main face 104 and the portion 112. The portions 112 and 114 are folded, as is visible in particular in FIG. 9, along a fold line 113 which is not parallel to the fold line 111, so as to form an angle α.

A free end of the portions 112, 114 is formed by a tab 116, folded and connected along a fold line 115 substantially parallel to the transverse fold line 111. This tab 116 is intended to be fixed to a side face 106 of the box which, when the box is in the made-up position, is adjacent to the first face 104. The portions 112 and 114 thus constitute a device for wedging the object that is to be packaged in the box.

It will be noted that the width of the portions 112 and 114 decreases from the transverse fold line 111 as far as the fold line 115 for folding the tab 116. Thus, the fold line 115 has substantially the same size as the width of the side face 106. The remainder of the box is configured in substantially the same way as the box illustrated in FIGS. 1*a,* 2, 3 and 4.

Unlike the embodiment of FIGS. 1*a,* 2, 3 and 4, the wedging structure 112 and 114 does not form a pocket in which the object that is to be packaged can be housed. What happens is that when the box is in the made-up position, the fold line 113 is directed substantially diagonally between the fold line 103 and the fold line 107. In consequence, the portion 114 is twisted through a 45° angle from the fold line 115 towards the fold line 113. This thus forms a housing inside the box, the housing being intended to accommodate an object, the cross section of this housing decreasing from the end 112*a* towards the bottom end wall panel 118. Through this configuration, the object to be packaged in the box can be wedged between the portion 114 and the internal walls of the faces 102 and 108. Because of the flexibility of the portion 114, for example when the flat blank 101*a* is made of a sheet of material such as cardboard, the object is held elastically in the box, without excessive stress being exerted on the object by the respective portions of the box.

FIG. 9 shows a simplified embodiment of the embodiment depicted in FIG. 4*a.* The box 1 of FIG. 9 can be distinguished from that of FIG. 4*a* by the fact that the internal wedging structure 12, 14 is bent about a second fold line 13 parallel to the first fold line 12*a.* In other words, the angle a (depicted in FIG. 4*a*) is zero. In addition, the free end 15*a* of the wedging structure is not glued to an internal wall of the sleeve, but is simply in free contact. Depending on the configuration of the tube T as it is introduced between the two parts 12 and 14 forming the wedging structure, these two parts bulge outwards elastically towards the corresponding faces of the sleeve. At the same time, the free end 15*a* can slide along the internal surface of the face 8. By elastic lateral contact exerted by the wedging structure, the tube is firmly gripped in the box.

During transport or when on display at a store, the boxes of the invention can be stacked without the packaged objects being able to accidentally change position and, perhaps, be damaged.

It will be apparent to those skilled in the art that various modifications and variations can be made to the structure and methodology of the present invention without departing from the scope or spirit of the invention Thus, it should be understood that the invention is not limited to the examples discussed in the specification. Rather, the present invention is intended to cover modifications and variations of this invention, provided they fall within the scope of the following claims and their equivalents.

What is claimed is:

1. A box for containing at least one object, the box comprising:

a substantially flat blank having a plurality of faces joined together along longitudinal fold lines, the faces forming, when the blank is folded along the fold lines, a sleeve having two ends, each configured to be closed by a respective end wall; and a wedging structure configured to wedge the at least one object inside the box, the wedging structure being formed from a portion of the blank extending substantially as a longitudinal continuation in the longitudinal direction of first face, the wedging structure being designed so as, when the box is assembled, to partially delimit at least one housing configured to house the at least one object, the at least one housing having a cross-section varying gradually along at least a portion of the at least one housing between first and second ends of the at least one housing.

2. The box of claim 1, wherein the cross-section of the at least one housing at the first end is substantially zero.

3. The box of claim 2, wherein the cross-section of the at least one housing at the second end is substantially equal to a cross-section of the sleeve.

4. The box of claim 1, wherein the wedging structure includes at least two parts forming the at least one housing.

5. The box of claim 1, wherein the portion of the blank forming the wedging structure is connected to the first face by a first transverse fold line, the portion having an end adjacent to the first face, and a free end configured, when the box is assembled, to be fixed to a second face located opposite from and facing the first face.

6. The box of claim 5, wherein the portion of the blank forming the wedging structure includes a second transverse fold line between the end adjacent to the first face and the free end, the portion being configured to fold about the second transverse fold line in order for the free end to be fixed to the second face.

7. The box of claim 6, wherein the second transverse fold line forms an end wall of a zone of the box that is configured to house the at least one object.

8. The box of claim 6, wherein the free end of the portion of the blank forming the wedging structure is fixed to the second face near an end of the box opposite an end of the box where the second transverse fold line is located.

9. The box of claim 1, wherein the portion of the blank forming the wedging structure is connected to the first face by a first transverse fold line, the portion having one end adjacent to the first face and a free end configured, when the box is assembled, to rest freely against a second face located opposite from and facing the first face, the free end lacking attachment to the second face.

10. The box of claim 1, wherein the portion of the blank forming the wedging structure is connected to the first face by a first transverse fold line, the portion comprising one end adjacent to the first face, and a free end configured, when the box is assembled, to be fixed to a second face adjacent to the first.

11. The box of claim 10, wherein the portion of the blank forming the wedging structure includes a second transverse fold line, between the end adjacent to the first face and the free end, the portion being configured to fold about the second transverse fold line in order for the free end to be fixed to the second face, the wedging structure comprising at least two parts from which the at least one housing is formed.

12. The box of claim 1, wherein the portion of the blank forming the wedging structure is configured to be twisted when the box is assembled.

13. The box of claim 6, wherein the second transverse fold line is not parallel to the first transverse fold line.

14. The box of claim 11, wherein the second transverse fold line is not parallel to the first transverse fold line.

15. The box of claim 13, wherein the second transverse fold line forms, with respect to the first transverse fold line, an angle $\alpha$ ranging from about 0° to about 45°.

16. The box of claim 15, wherein the angle $\alpha$ ranges from about 5° to about 35°.

17. The box of claim 14, wherein the second transverse fold line forms, with respect to the first transverse fold line, an angle $\alpha$ ranging from about 0° to about 45°.

18. The box of claim 17, wherein the angle $\alpha$ ranges from about 5° to about 35°.

19. The box of claim 15, wherein the angle $\alpha$ is chosen based on the dimensions of the box so that after the sleeve has been formed and after the wedging structure has been fixed to the second face, the box can be knocked down flat.

20. The box of claim 19, wherein the dimensions of the box used to choose the angle $\alpha$, are $L_1$, corresponding to the mean distance between the first transverse fold line and the second transverse fold line, and l, corresponding to the width of a face of the box adjacent to the first face.

21. The box of claim 17, wherein the angle $\alpha$ is chosen based on the dimensions of the box so that after the sleeve has been formed and after the wedging structure has been fixed to the second face, the box can be knocked down flat.

22. The box of claim 21, wherein the dimensions of the box used to choose the angle $\alpha$, are $L_1$, corresponding to the mean distance between the first transverse fold line and the second transverse fold line, and l, corresponding to the width of the face of the box that is adjacent to the first face.

23. The box of claim 1, wherein a free end of the portion of the blank forming the wedging structure includes a tab defined by a fold line, the tab being fixed to a zone located near one of the ends of the box.

24. The box of claim 6, wherein the second transverse fold line has a mid-point, the midpoint being located a first distance $L_1$ from the first transverse fold line and a second distance $L_2$ from a fold line at a free end of the portion of the blank forming the wedging structure, the distances $L_1$ and $L_2$ being substantially identical.

25. The box of claim 1, wherein the box is configured to contain a tube having a closed end formed along a closure line, the tube being equipped with a removable cap.

26. The box of claim 1, wherein the portion has an opening extending on each side of the second fold line, the opening configured to immobilize an end portion of the at least one object.

27. The box of claim 1, comprising two wedging structures, each wedging structure configured to wedge a separate object.

28. The box of claim 27, wherein the wedging structures are formed of a first portion of the blank and of a second portion of the blank, the first and second portions being oriented away from each other, each of the portions having a length at most equal to the height H of the box, defined by the length of the longitudinal fold lines of the sleeve.

29. The box of claim 1, wherein the blank is a single, unitary piece and pre-cut.

30. The box of claim 1, wherein the blank defines four faces of the box when folded along the fold lines.

31. The box of claim 1, wherein the longitudinal fold lines are substantially parallel fold lines.

32. The box of claim 1, wherein the blank is formed of a cardboard material.

33. A system comprising:

the box of claim 1; and a tube containing a product.

34. The system of claim 33, wherein the product is a cosmetic product.

35. A box for containing at least two separate objects, comprising:

a single-piece, pre-cut, substantially flat blank having four faces joined together along substantially parallel longitudinal fold lines, the faces forming, when the blank is folded along the fold lines, a sleeve having two ends, each configured to be closed by a respective end wall; and two wedging structures, each configured to wedge one separate object inside the box, the wedging structures being formed from portions of the flat blank, one portion extending substantially as a continuation of a first face and a second portion extending substantially as a continuation of a second face, the wedging structures being designed so as, when the box is assembled, to partially delimit two housings, each housing configured to house one respective object, each housing having a cross-section varying along at least a part of its length.

36. A method of making a box configured to contain at least one object, comprising:

providing a substantially flat blank having a plurality of faces joined together along longitudinal fold lines;

folding a portion of the blank forming a wedging structure and extending substantially as a longitudinal continuation in the longitudinal direction of a first face along a first transverse fold line;

folding the portion of the blank forming the wedging structure along a second transverse folding line such that a free end of the portion is adjacent to a second face when the box is assembled; and folding the blank along the longitudinal fold lines to form a sleeve having two ends.

37. The method of claim 36, further comprising gluing the free end of the portion of the blank forming the wedging structure to the second face.

38. The method of claim 36, further comprising closing the ends of the sleeve with flaps.

39. The method of claim 36, wherein the folding of the portion along the second transverse folding line includes folding the portion along a line forming an angle $\alpha$ with respect to the first transverse fold line.

40. The method of claim 36, further comprising:

folding a portion of the blank forming a second wedging structure and extending substantially as a continuation of the second face along a third transverse fold line; and folding the portion of the blank forming the second wedging structure along a fourth transverse folding line such that a free end of the second wedging structure portion is adjacent to the first face when the box is assembled.

41. The method of claim 40, further comprising fixing the free ends of the first and second wedging structures to the second and first faces, respectively.

* * * * *

UNITED STATES PATENT AND TRADEMARK OFFICE

CERTIFICATE OF CORRECTION

PATENT NO. : 6,484,876 B1 
DATED : November 26, 2002
INVENTOR(S) : Florent Duqueroie It is certified that error appears in the above-identified patent and that said Letters Patent is hereby corrected as shown below:

Column 10,
Line 1, please replace “of first” with -- of a first --.

Signed and Sealed this

Twenty-fifth Day of February, 2003

JAMES E. ROGAN
*Director of the United States Patent and Trademark Office*